US006082711A

United States Patent [19]

Peterson

[11] Patent Number: 6,082,711

[45] Date of Patent: Jul. 4, 2000

[54] CARBURETOR THROTTLE VALVE FLOW OPTIMIZER

[76] Inventor: Lonn Peterson, 21676 Deep Lake Rd., Richmond, Minn. 56368

[21] Appl. No.: 09/323,524

[22] Filed: Jun. 1, 1999

Related U.S. Application Data

[63] Continuation-in-part of application No. 08/922,925, Sep. 3, 1997, Pat. No. 5,942,159.

[51] Int. Cl.[7] ..... F02M 9/12

[52] U.S. Cl. ..... 261/44.1; 261/44.9; 261/62; 261/DIG. 38

[58] Field of Search ..... 261/44.1, 44.9, 261/62, DIG. 38, DIG. 55

[56] References Cited

U.S. PATENT DOCUMENTS

| | | | |
|---|---|---|---|
| 1,072,565 | 9/1913 | Brautigam | 261/44 |
| 1,129,864 | 3/1915 | Haas | 261/62 |
| 1,277,963 | 9/1918 | Lovejoy | 261/62 X |
| 1,414,935 | 5/1922 | Cox et al. | 261/44 |
| 1,444,222 | 2/1923 | Trego | 261/44 |
| 1,604,279 | 10/1926 | Guy | 261/44 |
| 2,062,496 | 12/1936 | Brokel | 261/44 |
| 2,756,033 | 7/1956 | Smith et al. | 261/44 |
| 2,776,821 | 1/1957 | Davis | 261/62 |
| 3,243,167 | 3/1966 | Winkler | 261/44 |
| 3,778,038 | 12/1973 | Eversole et al. | 261/62 X |
| 4,008,298 | 2/1977 | Quantz | 261/DIG. 38 |
| 4,108,952 | 8/1978 | Iwao | 261/44 |
| 4,150,070 | 4/1979 | Hashimoto et al. | 261/67 X |
| 4,206,158 | 6/1980 | Wood | 261/62 |
| 4,234,522 | 11/1980 | Fontanet et al. | 261/62 X |
| 4,765,933 | 8/1988 | Nagashima | 261/62 X |
| 4,783,286 | 11/1988 | Lee | 261/62 X |
| 5,942,159 | 8/1999 | Peterson | 261/44.1 |

*Primary Examiner*—Richard L. Chiesa
*Attorney, Agent, or Firm*—David George Johnson

[57] ABSTRACT

An aerodynamic piece (48) for use with a carburetor having a barrel or round slide throttle valve (10). The piece (48) is formed as an Insert which abuts the undersurface (15) of the slide (10). The piece (48) has an inclined bottom surface (28, 31, 32), the amount of inclination (43, 44, 45) being selected to increase the flow rate through the carburetor throat for a given throttle setting. Air flow passing through the carburetor throat hits the surface (28, 31, 32) and imparts a component of upward motion to the fuel (56) passing by the needle valve (11), thereby Increasing the available cross sectional area of the carburetor throat to which the fuel is exposed for atomization. An indented region (38) at the top of the piece (48) permits the use of the piece with a wide range of original equipment slides (10). A size of the pressure drop relief orifice (40) formed within the aerodynamic piece (48) permits the magnitude of the pressure drop across the needle valve (9) to be varied in a linear manner.

7 Claims, 8 Drawing Sheets

SECTION A-A

CARBURETOR THROTTLE VALVE FLOW OPTIMIZER

This application is a continuation in part of application Ser. No. 08/922,925, filed on Sep. 3, 1997, now U.S. Pat. No. 5,942,159.

1. FIELD OF THE INVENTION

This invention relates generally to the field of fuel and air induction systems for internal combustion engines, and more specifically to an aerodynamic throttle valve construction for use in a carburetor.

2. DESCRIPTION OF RELATED TECHNOLOGY

Various types of carburetors are commonly used in the small engines typically found in snowmobiles, personal watercraft, all terrain vehicles and motorcycles. These carburetors can be divided Into four basic types known as butterfly, downdraft, flat slide and round slide. These names refer to the mechanical element or action within the carburetor which serves as the control, or throttle, for the quantity and ratio of the of mixed fuel and air which makes its way into the intake manifold.

Snowmobiles typically include as original equipment a round slide (also known as a barrel slide) carburetor. In this configuration, the streamlines passing through the carburetor venturi are substantially perpendicular to the longitudinal axis of a cylinder which extends into the venturi. In the idle position, the cylinder (or round slide or barrel slide) substantially blocks almost the entire cross section of the venturi. As the round slide is withdrawn from the venturi, a larger amount of the venturi cross section is unblocked and is therefore free to admit a larger quantity of air and entrain a larger quantity of fuel. The round slide carburetor is relatively rugged in operation and is inexpensive to manufacture due to the simple cylindrical shapes involved. Unfortunately, the cylindrical shape which is simple to manufacture results in fluid dynamics which are quite complex. The air flowing through the venturi encounters both the curved shape of the barrel slide as well as the abrupt discontinuity of the barrel slide edge. Further, the barrel slide bottom surface is irregular since it must accommodate the needle and needle jet through which fuel is admitted to the venturi.

The overall result is a lack of linearity in throttle response, especially at the midrange throttle settings which are most commonly encountered in actual vehicle use. The standard barrel slide mechanism has such poor aerodynamics that it actually hinders or hampers fuel flow at midrange throttle settings. The lack of fuel delivery causes the mixture to become too lean, causing the engine temperature to increase. If the engine is permitted to frequently operate in this mode, the engine can actually seize, necessitating expensive repairs. The state of the art cure for engines that tend to run hot in midrange (usually higher performance engines) is to repeatedly "wing" or snap the throttle to the wide open position in order to throw a burst of fuel into the intake tract, thereby cooling the engine. The result of repeatedly snapping the throttle in this manner is poor fuel mileage as well as an annoyance to the operator of the vehicle. The quality of the engine emissions also suffers since an the overly rich fuel mixture causes unburned fuel to pass through the engine.

Larger bore carburetors Improve horsepower at higher engine revolutions at the expense of low and midrange horsepower. This loss is primarily due to the larger bore causing a lower fluid velocity through the carburetor throat, resulting in poor fuel atomization. The low air velocity causes an inadequate pressure drop, meaning that an insufficient fuel volume is delivered to the engine. Further, the low velocity fails to atomize the fuel sufficiently, exagerating the effect of an inadequate fuel volume. Finally, the turbulence existing in a conventional carburetor along with the poorly defined streamlines at low velocities causes some of the fuel to be misdirected.

Liquid fuel enters the carburetor through a component known as the needle jet, to which the main jet is attached. The turbulence and lack of pressure drop at low velocities beneath a conventional carburetor slide mechanism and surrounding the region of the needle jet make fuel delivery difficult and inefficient. The engine also runs lean during deceleration due to a lack of pressure drop. Engine failure often occurs due to overheating which can eventually lead to piston seizure.

An early example of a cylindrical obstruction in the carburetor throat is shown in U.S. Pat. No. 1,072,565, which discloses a stationary dome like structure that is used to form a venturi like restriction within the throat.

U.S. Pat. No. 1,444,222, issued to Trego, utilizes a cylindrical throttle valve having a rounded leading edge. The leading edge of the Trego valve serves to define a venturi like restriction in an otherwise straight walled carburetor throat.

U.S. Pat. No. 1,604,279 discloses a piston type throttle valve having a bevelled leading edge.

U.S. Pat. No. 2,062,496 discloses a piston type throttle valve having both rounded and bevelled edge contours.

U.S. Pat. No. 4,108,952, issued to lwao, discloses a round slide carburetor having a bevelled leading edge that changes the cross sectional characteristics of the venturi. The round slide also has an aerodynamic upper portion which resides in a chamber outside of the carburetor throat. As the intake manifold pressure decreases, a negative pressure is produced in the chamber which acts on the upper part of the round slide, causing it to lift and increase the cross sectional area of the carburetor throat. The round slide includes a step at its lower region which restricts flow and produces turbulence. The step has the effect of forcing or urging the fuel charge downwardly along the needle, rather than lifting it higher to expose the fuel to a larger cross section of the air flowing through the carburetor float.

All of the aforementioned devices suffer from drag producing surfaces and discontinuties in the carburetor float, caused either by the shape of the slide itself or by the machining within the carburetor throat required to accommodate the slide. An alternative to the barrel or round slide is a popular aftermarket modification known as the flat slide throttle valve, such as disclosed in U.S. Pat. No. 4,008,298.

The flatslide carburetor has a higher flowrate through the carburetor throat for a given pressure due to the lower frictional losses caused by the flat throttle plate. The lower losses are due to the relatively smaller surface area of the flat plate parallel to the direction of airflow. Whereas the round slide has an idealized frictional surface area equal to the area of the circular cross section of the barrel, the idealized frictional surface area of the flat slide carburetor is equal to the area of the flat plate edge times its width, which is typically a substantially lower value.

Further, the flat slide throttle plate occupies less volume in the carburetor throat and requires relatively less machining in areas of the throat that contribute to flow restrictions and random localized turbulence. In practice, the flat slide carburetor increases the flowrate by approximately 15% at intermediate throttle settings and a percent or so at full throttle. These improvements in performance come at a relatively high price due to the higher manufacturing costs of the flat slide configuration.

SUMMARY OF THE INVENTION

Accordingly, the present invention addresses the need for a relatively inexpensive method of obtaining the advantages of a flat slide throttle plate while preserving the basic simplicity of the barrel slide throttle valve. The present invention is an improved barrel slide throttle valve having a modified leading edge and lower surface which results in a significant reduction in frictional losses and the accompanying flow reduction. The improvement can be accomplished with existing barrel slides in the field using hand tools. The invention is directed primarily to an insert or appliance which is fitted to the bottom surface of an original equipment barrel slide. The present invention is an aerodynamic piece that attaches to a carburetor slide with a screw or possibly glue. The piece has the effect of reducing flow discontinuities, thereby increasing flowrate through the carburetor throat. Engine horsepower is directly related to flowrate, and so the present invention represents a method of increasing horsepower and throttle response. Improved airflow also improves fuel atomization, fuel mileage, and cleanliness of emissions.

The aerodynamic piece also functions as an engine tuning device. By varying the thickness of the leading edge, air flow can be more accurately controlled. The state of the art solution is to purchase an entirely new barrel slide which costs substantially more than the present invention. While the round slide throttle valve is therefore more tunable, it has suffered from a relative lack of mass flow when compared to a flat slide carburetor. The present invention therefore permits conversion of a barrel slide into the a throttle valve having the performance characteristics associated with the more expensive flat slide throttle valve.

In particular, the present invention causes the pressure drop to be maximized in the region of the needle jet, causing fuel to be atomized and delivered efficiently to the needle jet. During deceleration, this focused or centralized pressure drop causes fuel to be drawn into the engine, thereby cooling the cylinder and piston and reducing the likelihood of engine failure. The strength of the pressure drop or fuel signal during either acceleration or deceleration can be controlled by the size of the center orifice in the present invention. The size of the orifice determines how much air is allowed to pass between the present invention and the needle jet, thereby controlling the magnitude of the pressure drop or relavtive vacuum. A smaller orifice having a diameter just slightly larger than the needle jet itself permits maximum fuel delivery to occur between the present Invention and the needle jet, thereby enriching the fuel/air mixture within the carburetor. The leading edge (air entry side) of the present invention also determines how much air enters the carburetor during periods of initial acceleration. A steeper leading edge produces a leaner mixture while a shallower, less inclined leading edge enriches the mixture.

DETAILED DESCRIPTION OF THE PREFERRED EMBODIMENTS

Figure 1:
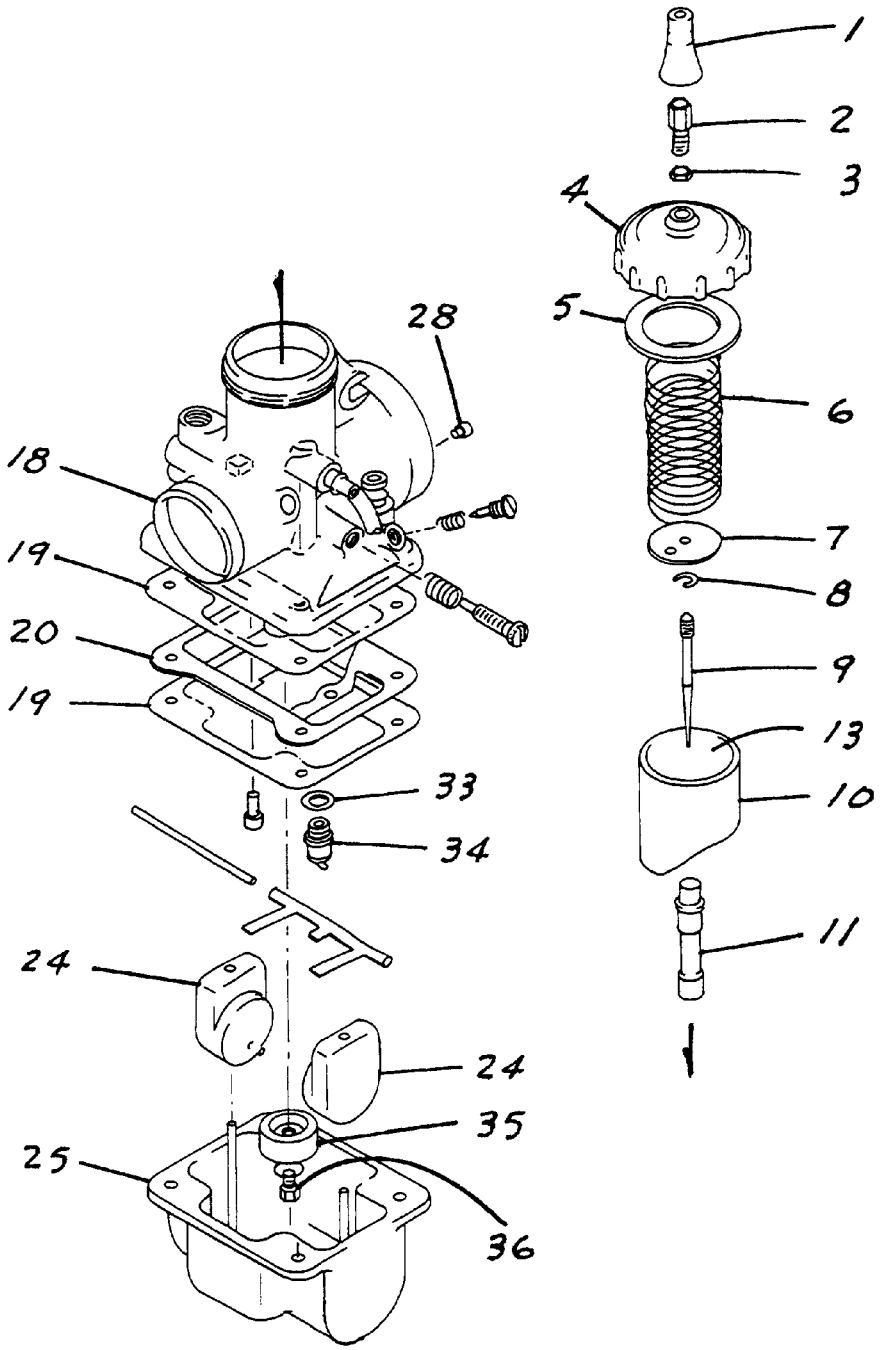
FIG. 1 is an exploded perspective view of a carburetor utilizing a barrel slide throttle valve.

Referring to FIG. 1, a carburetor utilizing a barrel slide is shown. The carburetor is housed within a body 18 and a mating bowl 25 which are joined via the baffle plate 20 and two gaskets 19. Within the bowl are housed two floats 24 which surround the main jet 36 and the main jet ring 35. Mounted within the body 18 is the needle valve and seat assembly 34 and needle valve washer 33. Fitting onto the needle valve seat is needle jet 11, within which fits needle 9. The needle 9 is controlled by a throttle cable (not shown) which passes through the cap 1 and having a length which is determined by cable adjuster 2 and secured by locknut 3. A top 4 and gasket 5 is secured to the body 18, the top 4 serving as a stop for throttle valve spring 6. The spring 6 acts against plate 7 to which is secured needle 9 by clip 8. The plate 7 abuts barrel slide 10 and is biased by spring 6 to travel in a direction toward the bowl 25.

Figure 2:
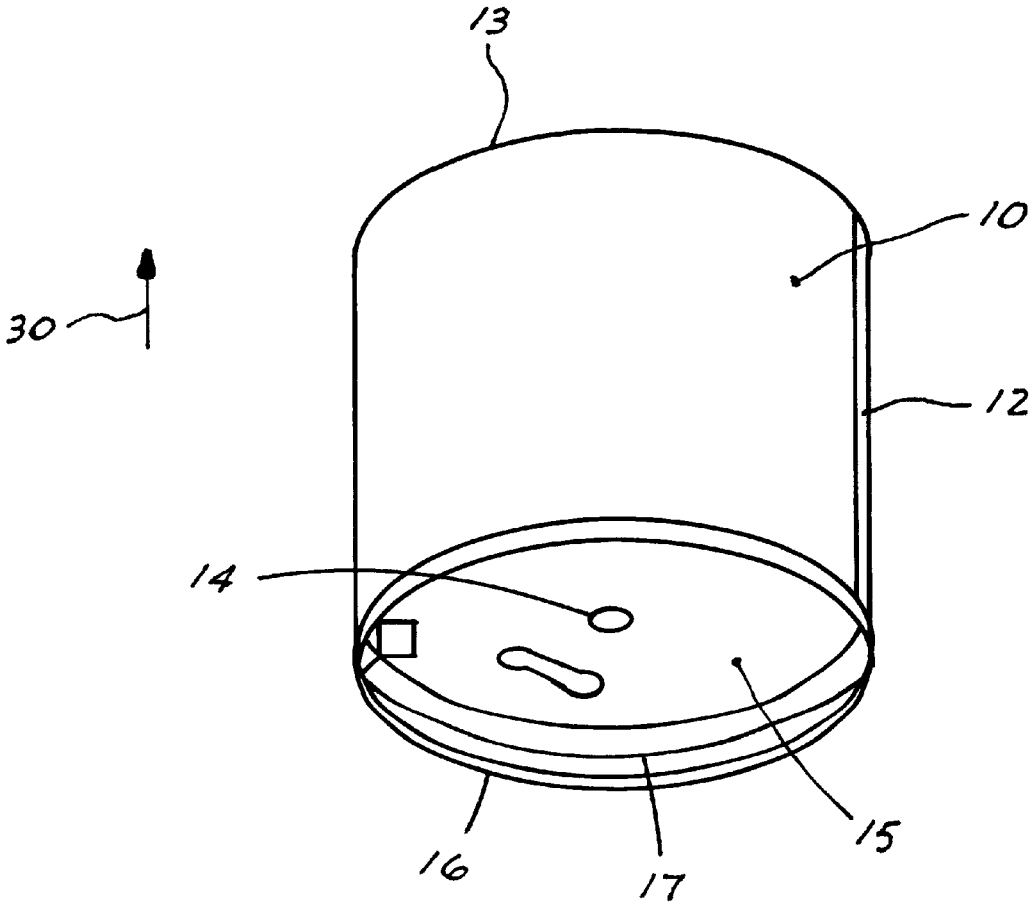
FIG. 2 is a perspective view of a carburetor barrel slide.

Referring also FIG. 2, the slide 10 is seen to be substantially cylindrical, having a top 13. Extending longitudinally along the side of the slide 10 is a guide groove 12 which fits into a mating rail (not shown) formed within the carburetor body 18. Formed through the center of the slide 10 is a bore 14 in order to accommodate the needle 9.

The undersurface 15 of the slide 10 is seen to be recessed so as to form a lip 16 and comer 17. These discontinuities 16 and 17 contribute to undesired random turbulent flow in the region surrounding undersurface 15.

Figure 3:
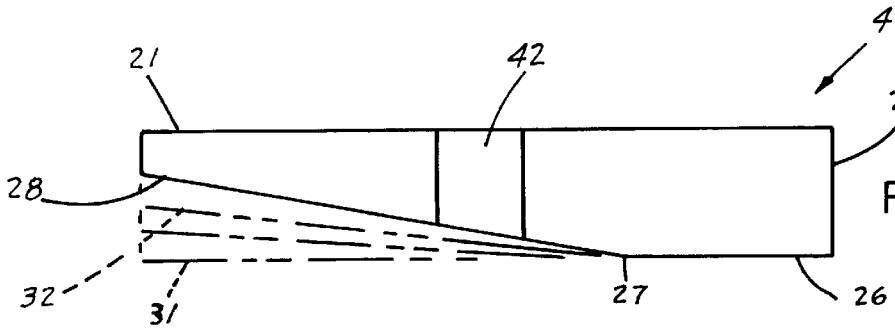
FIG. 3 is a left side elevation of an aerodynamic piece constructed according to the principles of the present invention.

As seen in FIG. 3, the present invention is an aerodynamic piece 48 which is formed to include a substantially planar top surface 21 which is substantially perpendicular to the perimeter or side 22. The top surface 21 is formed to mate with the bottom surface 15 of slide 10. The groove 42 on side 22 of the piece 48 is oriented so as to be aligned with groove 12 of barrel 10.

Figure 4:
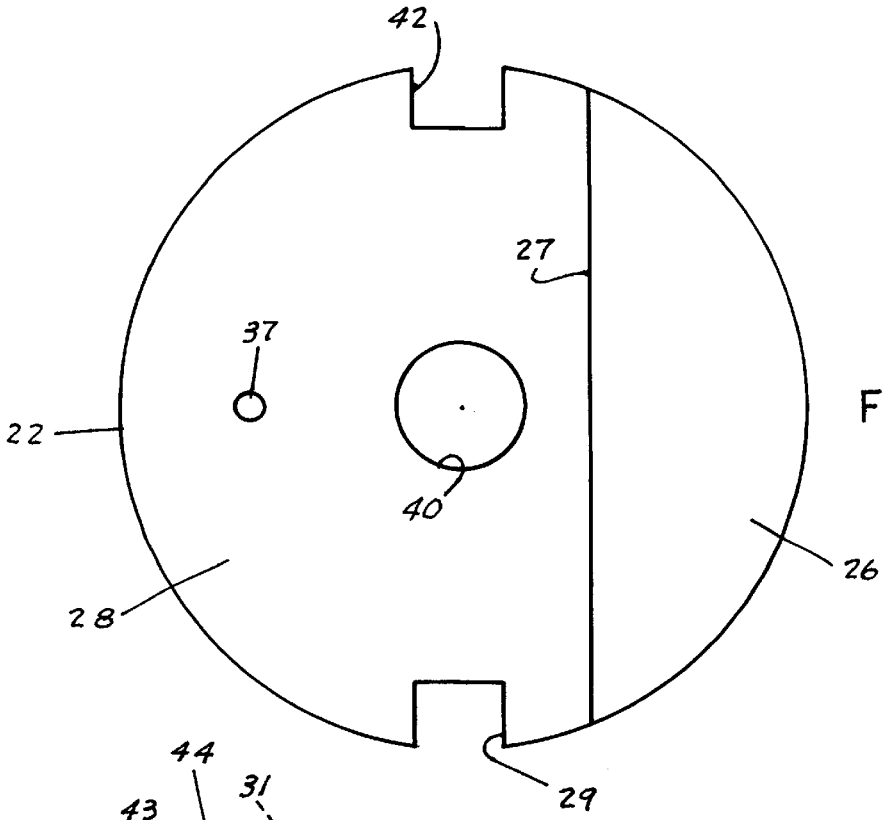
FIG. 4 is a bottom plan view of the aerodynamic piece depicted in FIG. 3.

Referring also to FIG. 4, the piece 48 is seen to have a first bottom surface 26 which is substantially planar and also substantially parallel to the top surface 21. The first surface 26 terminates at transition line 27. The second bottom surface 28 is inclined with respect to the first bottom surface 26, and extends from the transition line 27 to the piece perimeter 22. The second bottom surface 28 is penetrated by bore 40, which is positioned so as to be aligned with the needle bore 14 formed within barrel slide 10 when piece 48 is mounted on barrel undersurface 115. A second guide groove 29 is formed in perimeter surface 22 so as to be diametrally opposite to the first guide groove 42. The guide groove 29 is formed so as to mate with a guide rail (not shown) within carburetor body 18. A mounting hole 37 is formed in piece 48 pass through screw (not shown) to pass through piece 48 and be fastened to undersurface 15 of the slide 10.

Figure 10:
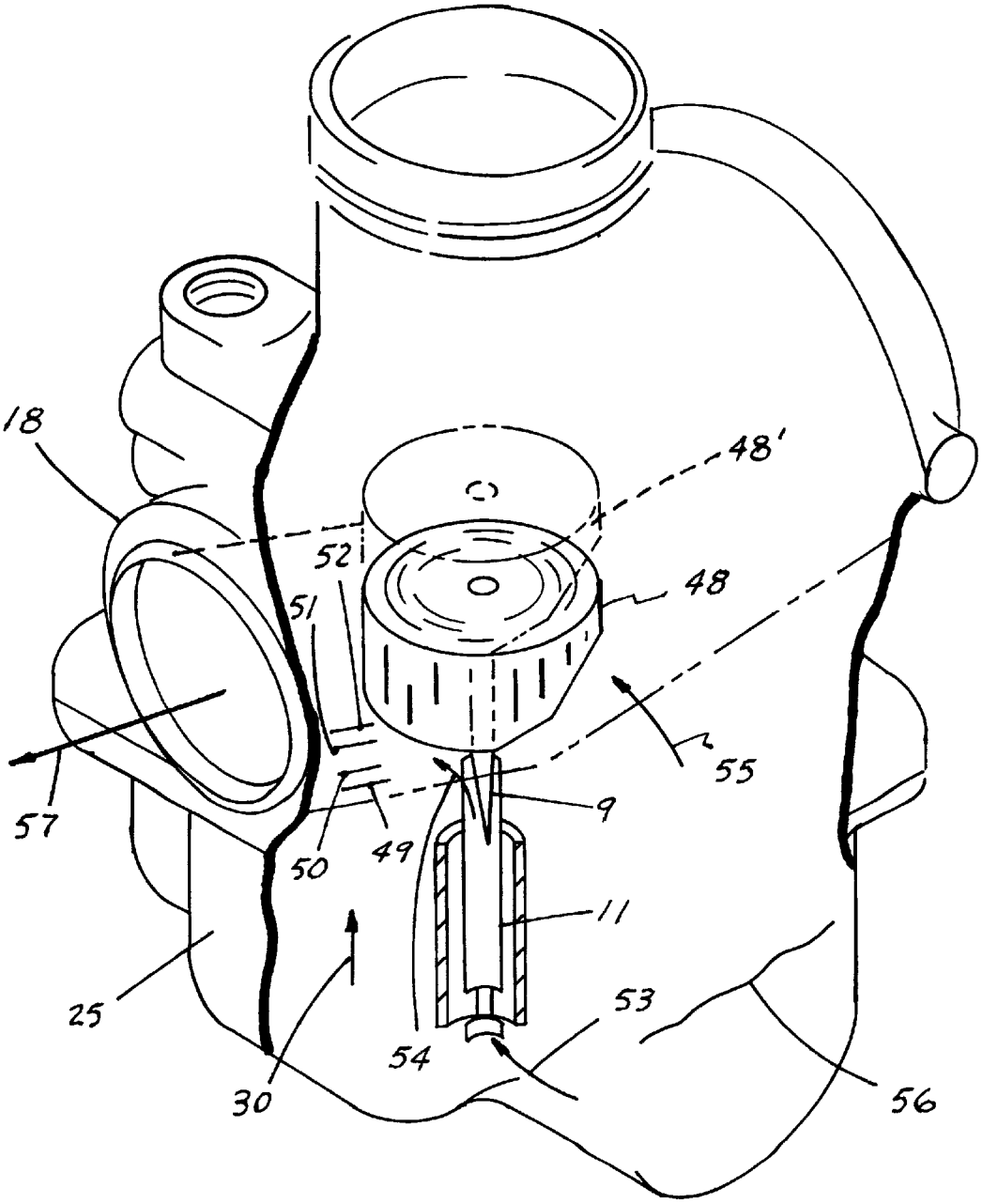
FIG. 10 is a perspective view, with portions broken away, of a carburetor employing the present invention.

The angle of inclination of second bottom surface 28 can be varied, and is chosen to provide an increase in the magnitude of the upward lifting force, generally in the direction of arrow 30, for a given volume of air flow through the carburetor mixing chamber throat. Score lines may be formed within the bottom surface 28 to permit a user to vary the angle of inclination in the field. Referring to FIG. 10, the effect of the aerodynamic piece on the lifting action within the carburetor throat 55 may be more readily appreciated. The fuel 56 residing within the chamber 25 is drawn into valve 11 generally along the path 53 due to the venturi action of air passing through throat 55. The fuel 56 enters throat 55 by passing adjacent to needle 9 generally along path 54.

The fuel 56 mixes with the air and exits the carburetor generally along the path 57. Ideally, the fuel/air mixture is homogeneous, a condition which is dependent on several factors, including the velocity of the air passing through throat 55 and the total volume of air passing through the throat 55. The pressure drop created by the venturi is able to accomplish efficient mixing of the fuel and air when head losses and turbulence within the throat 55 are minimized and the velocity and pressure drop are maximized.

The effect of the aerodynamic piece 48 can be thought of in two ways. First, the fuel is lifted to a relatively higher vertical level within the throat 55 cross section. For example, a conventional barrel slide at a given throttle setting may result in the fuel 56 residing within throat 55 at an average elevation 49 or 50. Since elevations 49 and 50 are relatively near the throat 55 sidewall 59, the velocity of the air is relatively small, and hence mixing will be relatively poor. With the piece 48 in use, the fuel 56 is lifted to an average elevation 51 or 52, which is nearer the center of the throat 55 cross section, a region of relatively higher velocity and hence better fuel atomization. A second way to visualize the effect of piece 48 is to consider the lifting force as actually raising the position of the piece to a new location such as 48. This has the effect of exposing more of the central cross section of throat 55, thereby increasing velocity and fuel atomization. In practice, some of each effect can be present, and in any event the throttle becomes more sensitive since its apparent mass has been reduced, even if only slightly.

Figure 5:
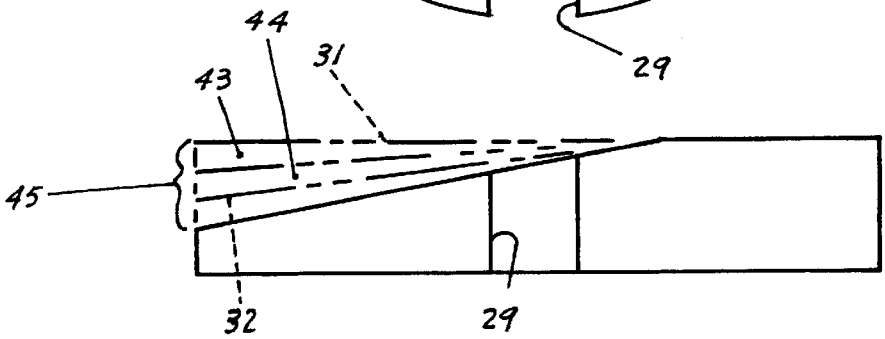
FIG. 5 is a right side elevation of the aerodynamic piece depicted in FIG. 4.

The angle of inclination of the bottom surface of piece 48 is dependent to varying degrees on the mass of the barrel 10, the force of the biasing spring 6, and the flow rate which results in midrange horsepower production for a given engine. The interdependence between the angle of inclination and the flowrate (or velocity) will determine when sufficient fuel atomization has occurred to achieve the desired engine horsepower at intermediate throttle settings. In practice, the angle typically varies between zero and thirty degrees. As seen in FIG. 5, an angle on the order of five degrees results in a second bottom surface 31, while an angle on the order of fifteen degrees produces second bottom surface 32. Second bottom surface 28 is inclined at an angle of approximately twenty five degrees with respect to first bottom surface 26.

An alternate method of measuring the inclination of the second bottom surface 28, 31 or 32 is to measure the amount of material removed from the sidewall 22. For example, the distance 43 corresponds to a removal of approximately 2.0 millimeters of material to produce surface 31. Distance 44 corresponds to an additional 0.5 millimeters, for a total material removal of 2.5 millimeters in order to produce bottom surface 32. Finally, distance 45 represents an additional removal of 0.5 millimeters, for a total removal of 3.0 millimeters to produce bottom surface 28. In practice, the material removal varies from 0.5 to 4.0 millimeters for carburetor throat diameters of 30 to 40 millimeters.

The commercial version of piece 48 is typically sold as an aftermarket kit featuring several substantially identical pieces, each varying only in the angle of inclination of the bottom surface of the leading edge 28, thereby permitting of barrel slide 10 regardless of their particular manufacturer. While the performance of the engine/carburetor the end user to try each piece to determine which provides the best performance with their actual carburetor/engine combination.

Figure 6:
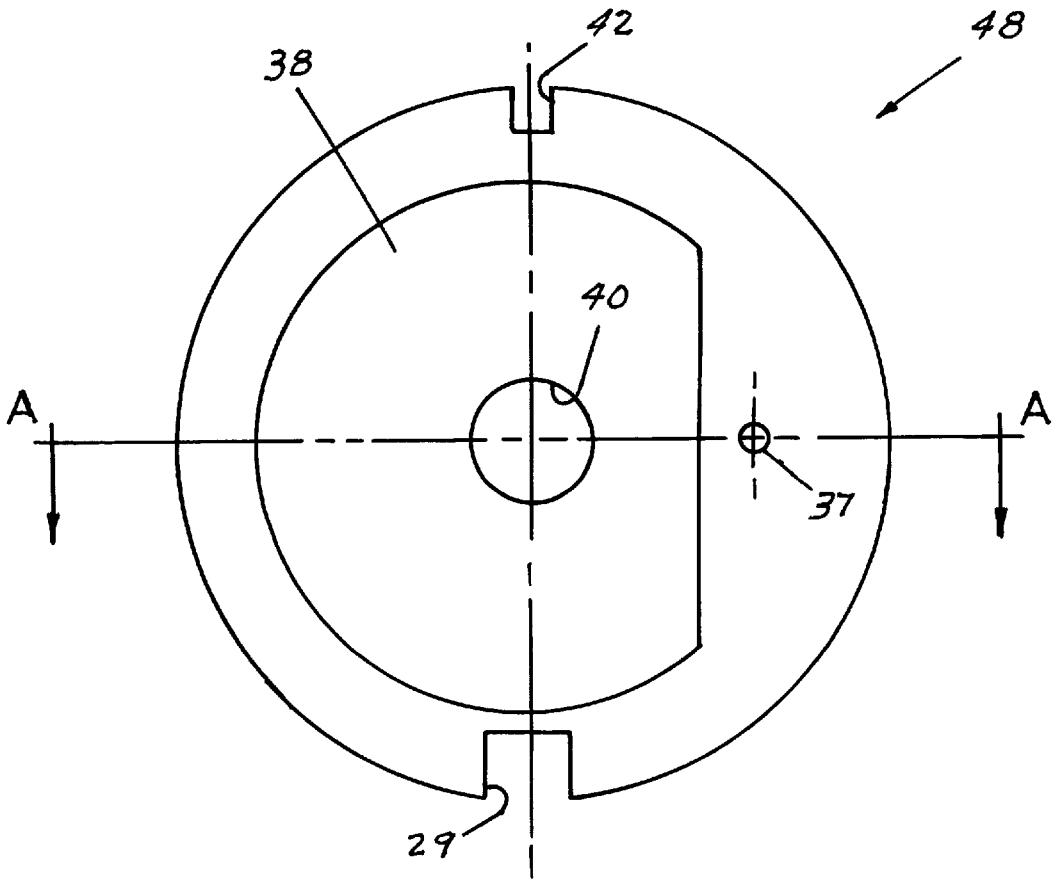
FIG. 6 is a top plan view of the aerodynamic piece depicted in FIG. 5.
Figure 7:
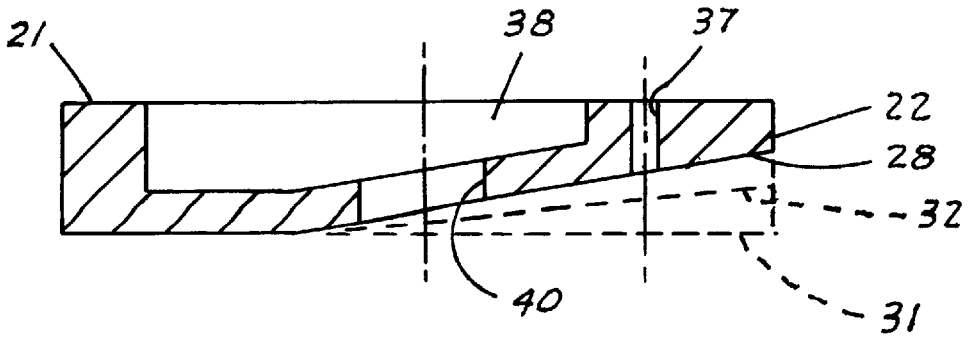
FIG. 7 is a sectional view taken along line 7—7 in FIG. 6.

As seen in FIGS. 6 and 7, an indented region 38 is formed within the top surface 21 of piece 48. The region 38 is provided to permit a single piece 48 to accommodate the various protrusions which may exist on the undersurface combination will vary according to the engine, intake manifold, atmospheric conditions, and the amount of inclination of bottom surface 28, 31, 32, etc., the following example is provided to give an indication of the performance advantages provided by the use of piece 18.

EXAMPLE 1

The following tests were performed on a Mikuni VM spigot mount type carburetor having a 38 millimeter throat diameter. The temperature drop across the venturi was fifty degrees farenheit, corresponding to a pressure drop equal to a water column of eight inches. In the table below: Column 1 represents the throttle position from zero to one, with zero corresponding to the idle position and one corresponding to a fully open throttle; Column 2 represents the flow rate through the carburetor throat, in cubic feet per minute, for a carburetor utilizing a round slide throttle valve; Column 3 represents the flow rate through the carburetor throat, in cubic feet per minute, for a carburetor utilizing a flat slide throttle valve; and Column 4 represents the flow rate through the carburetor throat, in cubic feet per minute, for a carburetor having a round slide throttle valve modified with piece 48.

| Throttle Position | Round Slide | Flat Slide | Aerodynamic Round Slide |
|---|---|---|---|
| 0 | 5.4 | 6.1 | 4.2 |
| 1/16 | 8.0 | 7.9 | 7.8 |
| 1/8 | 14.5 | 14.5 | 14.5 |
| 3/16 | 17.7 | 18.9 | 19.0 |
| 1/4 | 23.2 | 25.5 | 26.4 |
| 5/16 | 34.4 | 37.8 | 37.8 |
| 3/8 | 42.0 | 44.5 | 46.2 |
| 7/16 | 47.9 | 50.4 | 52.9 |
| 1/2 | 56.3 | 64.7 | 63.8 |
| 9/16 | 62.6 | 71.4 | 71.0 |

-continued

| Throttle Position | Round Slide | Flat Slide | Aerodynamic Round Slide |
|---|---|---|---|
| 5/8 | 83.3 | 90.7 | 92.5 |
| 11/16 | 96.2 | 98.1 | 103.6 |
| 3/4 | 109.2 | 112.9 | 114.7 |
| 13/16 | 116.6 | 122.1 | 124.0 |
| 7/8 | 125.8 | 133.2 | 131.4 |
| 15/16 | 131.4 | 142.5 | 138.8 |
| 1 | 147.1 | 154.5 | 147.1 |

As seen in the table, the aerodynamic round slide throttle valve produces a flow rate that is equal to or superior to the flow rate from a standard round slide throttle valve at all throttle positions except near idle, which is unimportant in during actual vehicle operation. The aerodynamic round slide also produces a flow rate that is superior to the flat slide throttle valve at several midrange throttle settings. Other similar tests have been performed, all producing similar results, namely an improvement in midrange flow rates comparable to flat slide throttle valves.

EXAMPLE 2

This example compares the pressure drop within the carburetor throat for a flat slide throttle valve, unmodified round slide throttle valve and a round slide throttle valve using the aerodynamic piece 48. The flowrate was adjusted in this test to produce a pressure drop equal to 4" of water at the main carburetor fuel jet. The table shows the pressure drop within the carburetor throat, also given in inches of water. The higher the pressure drop, the higher the fuel is lifted into the carburetor throat, thereby increasing the fuel atomization for a given throttle setting:

| Throttle Position | round slide with aerodynamic piece (UFO) | unmodified round slide | flat slide |
|---|---|---|---|
| idle | 1.5" | 0.625" | 0.5" |
| 1/4 | 2.5" | 1.25" | 1.75" |
| 1/2 | 3" | 2" | 2.5" |
| 3/4 | 3.625" | 3.125" | 3.25" |
| wide open | 3.25" | 3.25" | 3.65" |

Figure 8A:
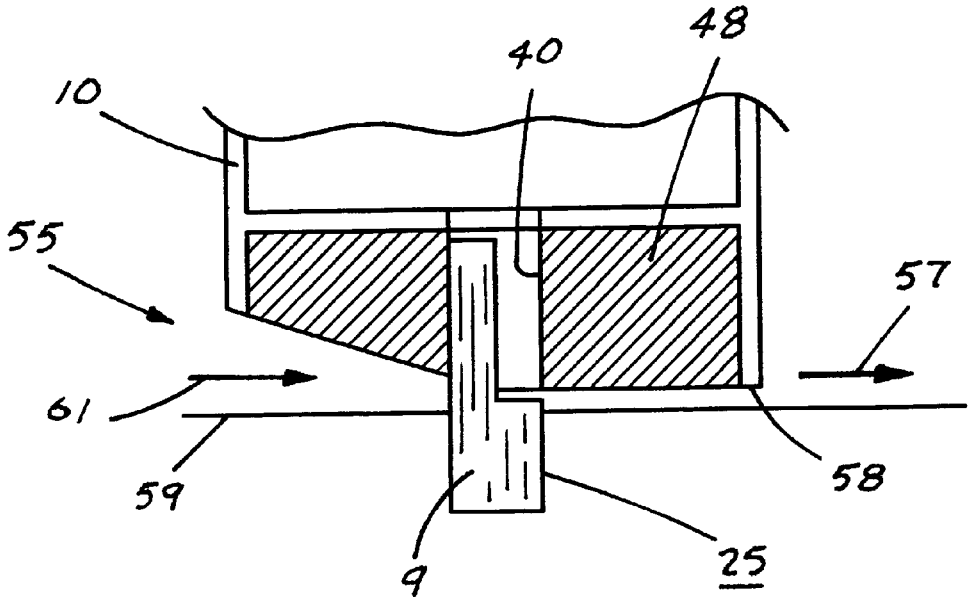
FIG. 8A is a side cutaway view of a carburetor utilizing the present invention while the engine is idling.
Figure 8B:
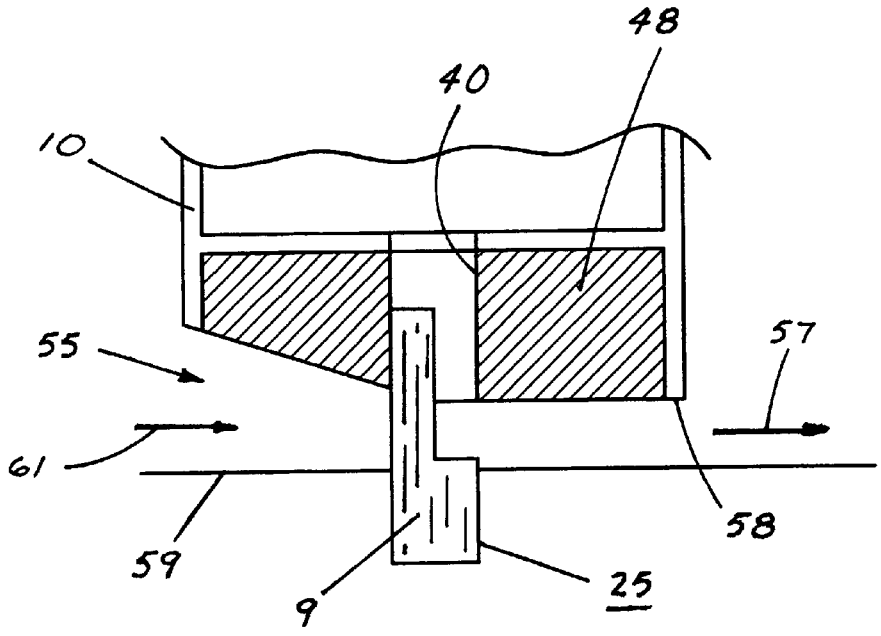
FIG. 8B is a side cutaway view of a carburetor utilizing the present invention while the engine is at a relatively low power setting.
Figure 8C:
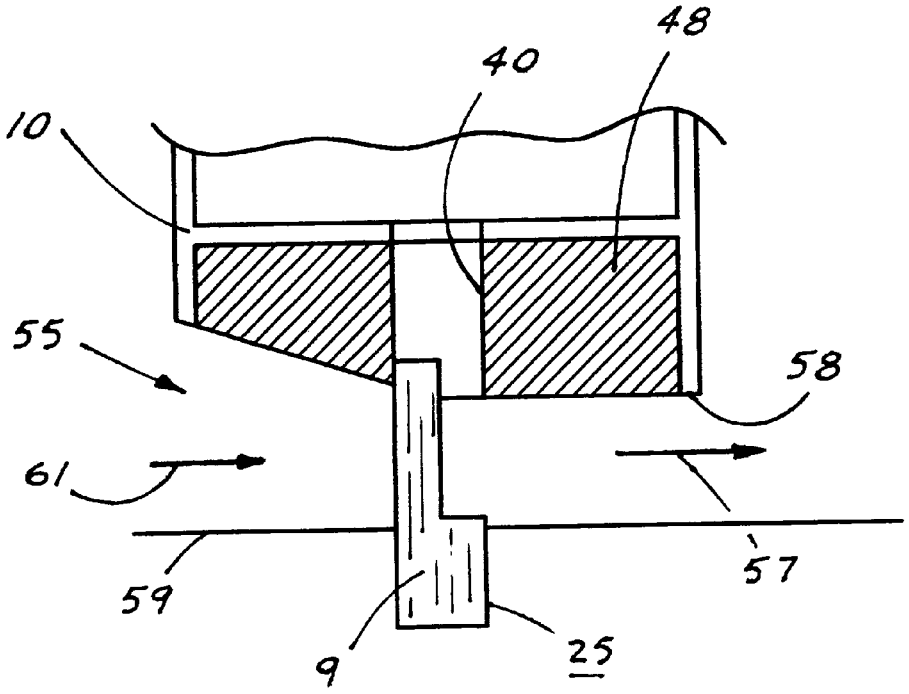
FIG. 8C is a side cutaway view of a carburetor utilizing the present invention while the engine is at a midrange power setting.

Referring to FIG. 8, the operation of the aerodynamic piece 48 can be better understood. The fuel resides In bowl 25 into which needle valve 9 extends. In position A, the valve 9 is at an extreme low throttle or idle setting as the lower edge 58 of slide 10 is quite near the sidewall 59 of carburetor bore 60. The crosshatched area into which aerodynamic piece 48 is installed is filled, thereby directing the entering airflow 61 to flow at a high speed toward exit path 57. In position B, at slightly higher throttle setting, the entering airflow is again directed to follow exit path 57, rather than entering the crosshatched area now occupied by aerodynamic piece 48. Finally, position C shows a high throttle setting In which the entering air 60 is directed along exit path 57 rather than being partially misdirected into the crosshatched area occupied by aerodynamic piece 58.

Figure 9A:
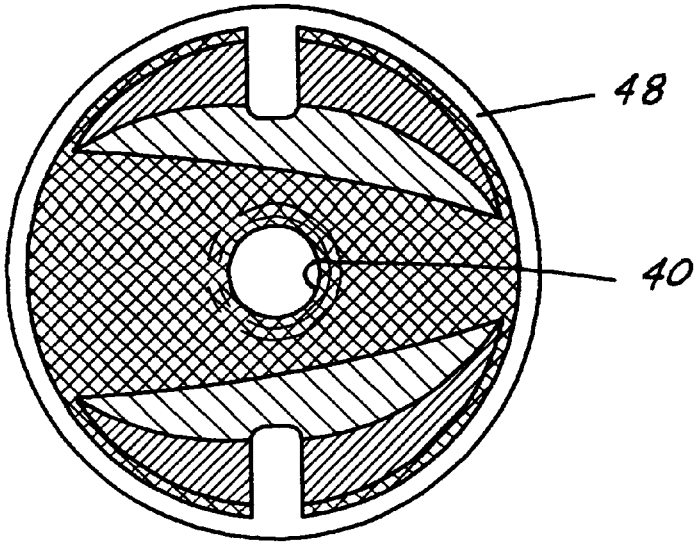
FIG. 9A is a bottom view of the present invention utilizing a standard size pressure drop relief orifice.
Figure 9B:
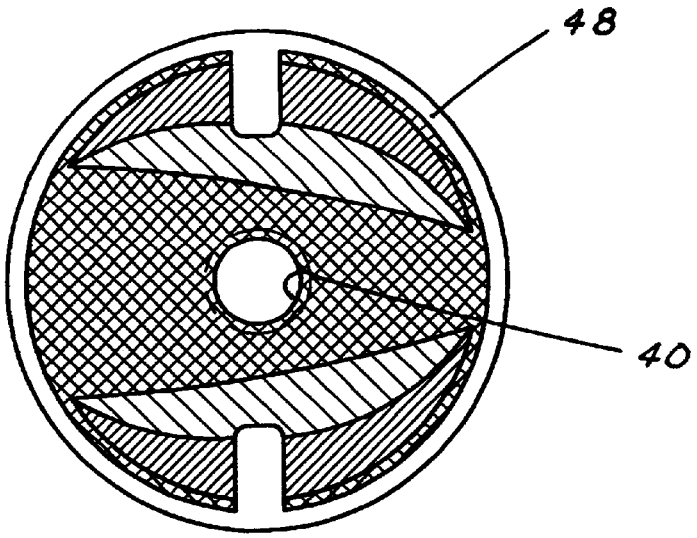
FIG. 9B is a bottom view of the present invention utilizing a pressure drop relief orifice increased to a first diameter.
Figure 9C:
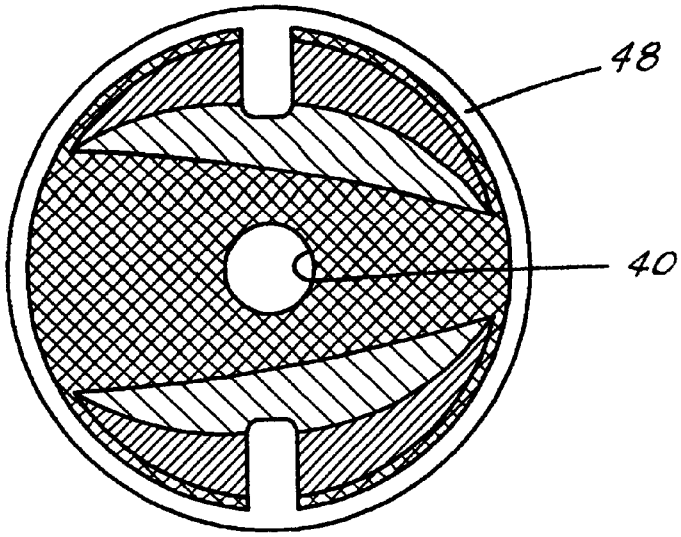
FIG. 9C is a bottom view of the present invention utilizing a pressure drop relief orifice increased further to a second diameter.

Referring also to FIG. 9, the effect of the pressure drop relief orifice 40 can be appreciated. In depiction A, the relative smaller diameter orifice 40 produces a strong pressure drop since the velocity of the air moving through orifice 40 must be relatively high for a given volume, in depiction B, the larger oriice 40 produces a relatively smaller pressure drop, while the large orifice 40 of depiction C produces the smallest pressure drop. The relationship between the size of orifice 40 and the pressure drop is linear.

While the present invention has been described with respect to these particular embodiments, those skilled in the field will appreciate that various modifications may be made with departing from the scope of the invention. For example, the bottom surface 28 does not have to be planar, but can be concave or contoured in a manner to maximize desired flow characteristics. While flow rate has been referred to as a desired parameter for maximization, the degree of fuel mixing, fuel atomization, air velocity or the magnitude of the lifting force exerted by the improved laminar flow characteristics through the carburetor throat are other characteristics that may be optimized by the piece 48.

I claim:

1. A method of applying a lifting force to a fuel and air supply residing within a carburetor mixing chamber throat within which a carburetor throttle valve resides, comprising the steps of:

a. forming an aerodynamic piece; and b. affixing the aerodynamic piece to the carburetor throttle valve so as to substantially fill and eliminate turbulence within a recessed undersurface at the base of the carburetor throttle valve so as to exert a lifting force on the fuel and air supply residing within the carburetor mixing chamber throat when air flows through the carburetor mixing chamber throat.

2. The method of claim 1 further comprising the steps of:

a. forming the aerodynamic piece as a plurality of substantially planar surfaces having angles of inclination with respect to a longitudinal axis of the carburetor mixing chamber throat; and b. orienting the aerodynamic piece so that a planar surface having a relatively greatest angle of inclination is upstream of planar surfaces having relatively smaller angles of inclination.

3. The method of claim 2, further comprising the step of forming the aerodynamic piece such that the throttle valve occludes a relatively smaller cross section of the carburetor mixing chamber throat for a given flowrate through the throat than when an aerodynamic piece is not affixed to the throttle valve.

4. The method of claim 3, further comprising the step of forming the aerodynamic piece such that flowrate through the mixing chamber throat is relatively higher for midrange throttle settings than when an aerodynamic piece is not affixed to the throttle valve.

5. The method of claim 4 further comprising the step of forming a pressure drop relief orifice within the aerodynamic piece, the pressure drop relief orifice being substantially coaxial with a carburetor needle valve.

6. The method of claim 5 further comprising the step of altering a cross-sectional dimension of the pressure drop relief orifice in order to alter a pressure magnitude in a region surrounding the carburetor needle valve.

7. The method of claim 6 further comprising the step of forming the aerodynamic piece such that a relatively steeper angle of inclination of the upstream planar surface creates a relatively leaner fuel to air mixture ratio within the carburetor mixing chamber throat.

* * * * *